US006884491B2

(12) United States Patent
Rubin et al.

(10) Patent No.: US 6,884,491 B2
(45) Date of Patent: Apr. 26, 2005

(54) TREATED TEXTILE FABRIC

(75) Inventors: Craig A. Rubin, Franklin, MI (US); Randy B. Rubin, Franklin, MI (US); Kyle Bullock, Forest City, NC (US)

(73) Assignee: Hi-Tex, Inc., West Bloomfield, MI (US)

( * ) Notice: Subject to any disclaimer, the term of this patent is extended or adjusted under 35 U.S.C. 154(b) by 56 days.

(21) Appl. No.: 10/238,142

(22) Filed: Sep. 10, 2002

(65) Prior Publication Data

US 2003/0008585 A1 Jan. 9, 2003

Related U.S. Application Data

(63) Continuation of application No. 09/603,850, filed on Jun. 26, 2000, now Pat. No. 6,492,001, which is a continuation-in-part of application No. 09/050,514, filed on Mar. 30, 1998, now Pat. No. 6,207,250, which is a continuation-in-part of application No. 08/687,527, filed as application No. PCT/US95/03566 on Mar. 21, 1995, now Pat. No. 6,874,823.

(51) Int. Cl.[7] ..... B32B 3/10

(52) U.S. Cl. ..... 428/137; 428/908.8; 427/288; 156/275.5; 156/272.2; 156/274.8; 442/85; 442/286

(58) Field of Search ..... 428/304.4, 907, 428/908.8, 223, 317.1, 137, 265, 908; 427/261, 288, 407, 322; 156/274.8, 275.5, 272.2, 230; 442/65, 85, 226, 286, 148

(56) References Cited

U.S. PATENT DOCUMENTS

| | | | |
|---|---|---|---|
| 3,023,072 | A | 2/1962 | Dabrowski |
| 3,105,773 | A | 10/1963 | Frank et al. |
| 3,111,361 | A | 11/1963 | Fang |
| 3,238,010 | A | 3/1966 | Habib et al. |
| 3,256,230 | A | 6/1966 | Johnson, Jr. et al. |
| 3,326,713 | A | 6/1967 | Smith et al. |
| 3,419,533 | A | 12/1968 | Dieterich |
| 3,462,295 | A | 8/1969 | Elmquist et al. |
| 3,462,296 | A | 8/1969 | Raynolds et al. |
| 3,479,310 | A | 11/1969 | Dieterich |
| 3,503,915 | A | 3/1970 | Peterson |
| 3,521,993 | A | 7/1970 | Swidler et al. |
| 3,528,849 | A | 9/1970 | Vullo et al. |
| 3,535,156 | A | 10/1970 | Turner |
| 3,540,924 | A | 11/1970 | Rozek et al. |
| 3,544,663 | A | 12/1970 | Hamptschein et al. |
| 3,597,145 | A | 8/1971 | Marco |
| 3,607,493 | A | 9/1971 | Anderson |
| 3,645,989 | A | 2/1972 | Tandy, Jr. |
| 3,645,990 | A | 2/1972 | Raynolds |
| 3,649,344 | A | 3/1972 | Crabtree et al. |
| 3,652,198 | A | 3/1972 | Farber et al. |
| 3,713,878 | A | 1/1973 | Thomas |
| 3,773,545 | A | 11/1973 | Erb et al. |
| 3,922,399 | A | 11/1975 | Ochsner |
| 3,935,277 | A | 1/1976 | Dear et al. |
| 3,995,085 | A | 11/1976 | McCown |
| 4,007,305 | A | 2/1977 | Kakar et al. |
| 4,027,062 | A | 5/1977 | Engelbrecht et al. |
| 4,070,152 | A | 1/1978 | Pentz |
| 4,076,631 | A | 2/1978 | Caruso et al. |
| 4,107,055 | A | 8/1978 | Sukornick et al. |
| 4,108,814 | A | 8/1978 | Reiff et al. |
| 4,113,432 | A | 9/1978 | Otto |

(Continued)

FOREIGN PATENT DOCUMENTS

| | | |
|---|---|---|
| DE | 32 31 062 A1 | 2/1984 |
| DE | 34 15 920 A1 | 11/1985 |
| DE | 38 36 030 A1 | 5/1990 |
| EP | 0 097 995 A2 | 1/1984 |
| EP | 0 383 310 A3 | 8/1990 |
| EP | 0 491 198 A1 | 6/1992 |
| EP | 0 525 671 A1 | 2/1993 |
| GB | 1 595 580 | 8/1981 |
| JP | 1-97274 | 4/1989 |
| JP | 3-195737 | 8/1991 |
| JP | 6-31845 | 2/1994 |
| JP | 6-108365 | 4/1994 |
| WO | WO 95/25843 | 9/1995 |
| WO | WO 99/50062 | 10/1999 |

OTHER PUBLICATIONS

John C. Tsirovasiles et al, *The Use of Water–Borne Urethane Polymers in Fabric Coatings*, J. Coated Fabrics (1986), Oct. 16, pp. 114–122.

Joseph W. Weinberg, *Performance And Application Advantages of Waterborne systems In The Automotive And Textile Industries*, J. Industrial Fabrics (1986) 4(4), pp. 29–38.

D. D. Gagliardi and Virginia Kenney, "Durable Antimicrobial Finishes For Textiles", Gagliardi Research Corp., East Greenwich, R. I., pp. 121–125.

"A 400–Year–Old Collection of Italian Dyeing Recipes More Than Meets The Eye" By: Francis DL Gagliardi, Gagliardi Research Corp, East Greenwich, R.I. vol. 1, No. 25, Dec. 3, 1969, pp. 18–21.

"Cotton Finishing: Where It Stands, and What's Ahead" By: D. D. Gagliardi, Gagliardi Research Corp., East Greenwich, R. I., Textile World, Feb. 1962, pp. 86–97.

"Antibacterial Finishes", By: D. D. Gagliardi, Gagliardi Research Corp., East Greenwich, R. I., American Association of Textile Chemists and Colorists, Copyright 1962, No. 2, pp. 30–41.

*Primary Examiner*—Merrick Dixon
(74) *Attorney, Agent, or Firm*—Brooks Kushman P.C.

(57) ABSTRACT

The present invention provides a water repellant, water resistant, stain resistant fabric that feels like fabric rather than plastic. The fabric of the present invention is prepared by treating a fabric with at least one treatment composition comprising from about 5 weight percent to about 20 weight percent of fluorochemical(s), which is then backed with at least one polymeric film to provide a water repellant, water resistant, stain resistant fabric.

29 Claims, No Drawings

U.S. PATENT DOCUMENTS 4,183,836 A 1/1980 Wolfe, Jr.
4,189,429 A 2/1980 Lambert, Jr.
4,203,883 A 5/1980 Hangauer, Jr.
4,208,173 A 6/1980 Gregorian et al.
4,219,602 A 8/1980 Conklin
4,230,753 A 10/1980 Sheyon
4,246,311 A 1/1981 Hirst
4,256,459 A 3/1981 Russell et al.
4,265,962 A 5/1981 May
4,290,846 A 9/1981 Muntwyler
4,336,300 A 6/1982 Lorant et al.
4,365,968 A 12/1982 Gregorian et al.
4,400,414 A 8/1983 DeMott
4,401,712 A 8/1983 Morrison
4,408,008 A 10/1983 Markusch
4,439,473 A 3/1984 Lippman
4,455,147 A 6/1984 Lewis et al.
4,467,013 A 8/1984 Baldwin
4,496,363 A 1/1985 DeFilippi
4,499,139 A 2/1985 Schortmann
4,507,413 A 3/1985 Thoma et al.
4,507,430 A 3/1985 Shimada et al.
4,518,649 A 5/1985 Wang et al.
4,594,286 A 6/1986 McKinney et al.
4,595,518 A 6/1986 Raynolds et al.
4,598,120 A 7/1986 Thoma et al.
4,615,937 A 10/1986 Bouchette
4,619,854 A 10/1986 Penttinen
4,695,488 A 9/1987 Hisamoto et al.
4,721,511 A 1/1988 Kupits
4,740,398 A 4/1988 Bouchette
4,775,384 A 10/1988 Bachem et al.
4,795,675 A 1/1989 Dunn, Jr. et al.
4,808,466 A 2/1989 Kotani et al.
4,822,667 A 4/1989 Goad et al.
4,833,006 A 5/1989 McKinney et al.
4,835,019 A 5/1989 White et al.
4,837,079 A 6/1989 Quantrille et al.
4,844,952 A 7/1989 Korenkiewicz et al.
4,861,501 A 8/1989 Pfeifer
4,889,765 A 12/1989 Wallace
4,901,389 A 2/1990 Poulenard et al.
4,919,998 A 4/1990 Goad et al.
4,921,756 A 5/1990 Tolbert et al.
4,929,471 A 5/1990 Groelinger
4,971,835 A 11/1990 Munch et al.
4,996,099 A * 2/1991 Cooke et al. ..... 442/4
5,006,247 A 4/1991 Dennison et al.
5,009,667 A 4/1991 Beck et al.
5,019,422 A 5/1991 Rose et al.
5,034,266 A 7/1991 Kinlaw et al.
5,035,943 A 7/1991 Kinlaw et al.
5,091,243 A 2/1992 Tolbert et al.
5,108,836 A 4/1992 Ocampo et al.
5,126,138 A 6/1992 McGee et al.
5,177,141 A * 1/1993 Thoma et al. ..... 524/591
5,194,667 A 3/1993 Oxenrider et al.
5,196,080 A 3/1993 Mizobuchi et al.
5,262,444 A 11/1993 Rusincovitch et al.
5,306,764 A 4/1994 Chen
5,358,780 A 10/1994 Kafchinski et al.
5,399,419 A 3/1995 Porter et al.
5,545,451 A 8/1996 Haung et al.
5,565,265 A 10/1996 Rubin et al.
5,618,853 A 4/1997 Vonken et al.
5,747,392 A 5/1998 Xiao et al.
5,851,595 A 12/1998 Jones, Jr.
6,024,823 A 2/2000 Rubin et al.
6,165,920 A 12/2000 Rubin et al.
6,207,250 B1 3/2001 Bullock et al.
6,251,210 B1 6/2001 Rubin et al.

* cited by examiner

TREATED TEXTILE FABRIC

CROSS-REFERENCE TO RELATED APPLICATIONS

This application is a continuation of U.S. patent application Ser. No. 09/603,850, filed Jun. 26, 2000 now U.S. Pat. No. 6,492,001 which is a continuation-in-part of U.S. patent application Ser. No. 09/050,514, filed Mar. 30, 1998, entitled "Treated Textile Fabric", now U.S. Pat. No. 6,207,250, which is a continuation-in-part of U.S. patent application Ser. No. 08/687,527, filed Aug. 7, 1996, now U.S. Pat. No. 6,074,823, which was the National Stage of International Application No. PCT/US95/03566, filed Mar. 21, 1995, which are hereby incorporated by reference.

BACKGROUND OF THE INVENTION

1. Field of the Invention

The present invention relates to treated textile fabric and to a method of treating a textile fabric. The present invention more particularly relates to a method of preparing a water resistant, water repellant, and stain resistant fabric, and to the textile fabric so prepared.

2. Background Art

Stain resistance, water repellency and water resistance are important in many uses of textile materials. In restaurants, for example, table cloths and seating upholstery often lack stain resistance and are subject to rapid liquid, i.e., water, penetration. These properties necessitate frequent cleaning and/or replacement of such items. Although one generally views microbial growth as being associated with fibers of biologic origin such as cotton, wool, linen and silk, in the field of marine use, the high relative humidity renders even synthetic polymer textiles, such as polyesters and polyamides, subject to microbial growth, which is also true of many other outdoor uses.

The term "water resistant" as used herein means essentially impermeable to liquids, such as water, i.e. treated textile fabric can support a considerable column of water without water penetration through the textile fabric. Such behavior is sometimes incorrectly termed "water repellant." However, the last term generally implies a lesser degree of water resistancy. Water repellency refers to the beading up and running off of water on a surface. Hydrophobicizing topical treatments are incapable of providing the necessary degree of water resistance as that term is used herein.

Textile fabrics may be made somewhat water repellant by various processes. For example, textile fabrics may first be scoured with a soap solution and then treated with a composition which may include zinc and calcium stearates as well as sodium soaps. The long chain carboxylic acid hydrophobic compounds provide a limited amount of water repellency. It is also possible to render fabrics somewhat liquid repellant by treating the fabric with commercially available silicone, for example poly(dimethylsiloxane).

To overcome problems associated with water absorption and stain resistance, resort has been made to synthetic leathers and polyvinylchloride (vinyl) coated fabrics. However, these fabrics do not have the hand or feel of cloth. Moreover, although attempts have been made to render such materials water vapor permeable, these attempts have met with only very limited success, as evidenced by the failure of synthetic leather to displace real leather in high quality seating and footwear.

Applications of relatively small amounts of fluorochemicals, such as the well known SCOTCHGUARD™ to textile fabrics and similar compounds, also may confer a limited degree of both water repellency and stain resistance to the textile fabric. However, these "SCOTCHGUARD™ed" textile fabrics are incapable of providing the degree of water repellency, water resistance, and stain resistance, as achieved by the present invention. Other methods of providing water repellant fabrics include coating the top surface of fabrics with thick polymeric coatings. These polymeric coatings, being on the top surface of the fabric, completely destroy the hand and feel of the fabric. Examples include vinyl boat covers, where the fabric backing is rendered water repellant by application of considerable quantities of polyvinylchloride latex or the thermoforming of a polyvinyl film onto the top of the fabric. The fabric no longer has the hand and feel of untreated fabric, but is plastic-like. Application of polyurethane films in the melt has also been practiced, with similar results. Moreover, unless aliphatic isocyanate-based polyurethanes are utilized, the coated fabric will rapidly weather.

The applicants of the present invention developed a treated fabric known as CRYPTON™ which is disclosed in U.S. Pat. Nos. 5,565,265 and 6,024,823. The Crypton™ fabric is liquid repellant, liquid resistant, stain resistant and antimicrobial. The Crypton™ fabric is prepared by topically treating a fabric with a first, relatively low viscosity, aqueous treatment composition comprising an antimicrobial agent and a substantial amount of fluorochemical treatment composition. After passing through the first bath, the fabric is dried and cured, and then a relatively high viscosity treatment composition is knife-coated on the backside of the fabric to further treat the fabric, which is then dried and cured again. This knife coat treatment can be done once, or more than once.

It would be desirable to provide a fabric that allows water vapor to pass through the fabric while prohibiting the passage of liquid. It would also be desirable to provide a method of producing a liquid repellant, liquid resistant, stain resistant fabric. It would further be desirable to provide a liquid repellant, liquid resistant, stain resistant fabric that retains its natural hand and texture, is easy to handle, and economical to produce. Moreover, it would be further desirable to provide a liquid repellant, liquid resistant, stain resistant fabric that can be made relatively cleanly and with relatively little expenditure of time and money.

SUMMARY OF THE INVENTION

The present invention provides a water resistant, water repellant stain resistant, aesthetically and tactile pleasing fabric that does not feel like plastic. The fabric of the present invention is prepared by treating a fabric with at least one treatment composition comprising from about 5 weight percent to about 20 weight percent of fluorochemical(s), with the treated fabric then being backed with at least one polymeric film to provide a water repellant, water resistant, stain resistant, fabric.

DETAILED DESCRIPTION OF THE PREFERRED EMBODIMENT(S)

The water resistant, water repellant, stain resistant fabric of the present invention retains its natural "hand" or texture and is therefore aesthetically and texturally appealing. The fabric of the present invention is also durable, easy to handle and economical to produce.

The fabrics useful in the present invention include, but are not limited to, woven, non-woven and knitted fabrics, and preferably yarn or piece dyed upholstery woven fabrics, of natural fibers, synthetic fibers and mixtures of natural and synthetic fibers. Suitable natural fibers include, but are not limited to, fibers of cotton, linen, ramie, silk, wool and the like. Suitable synthetic fibers include, but are not limited to, fibers of nylon, polyester, acrylic, rayon, acetate and the like. Suitable fabrics for use with the present invention include, but are not limited to, jacquards (i.e., fabrics manufactured from a jacquard loom), brocades, dobbys (i.e., fabrics manufactured from a dobby loom), prints, poplins, cross-dyes, crepes, and canvases.

The treating process of the subject invention involves, in a first step, treating the fabric with a penetrating aqueous treatment composition, hereinafter referred to as the treatment composition. The treatment composition, in its most basic nature, comprises a substantial amount of a fluorochemical treating agent, and water. The treatment composition may preferably include one or more antimicrobial agents, such as microbioicides and/or mildewcides. The nature of the treatment composition is such that the fabric is thoroughly treated by topically treating the fabric, the treatment composition covering equally well both sides (i.e., surfaces) of the fabric as well as the surfaces of the fabric to cover the interstitial spaces within the fabric. The fabric is then oven dried and cured at elevated temperatures, for example, from 250° F. to 350° F. (121° C. to 177° C.), resulting in a primarily treated fabric. The primarily treated fabric is stain resistant, water repellant, and water resistant. In addition, its tensile and tear strengths are markedly improved. Yet, the primarily treated fabric is very difficult to distinguish from untreated fabric by hand, feel, texture, or ease of handling.

Although the process described above creates a unique new textile material, i.e., the primarily treated fabric, the primarily treated fabric is generally not completely water resistant. Inspection of the primarily treated fabric against a light source reveals multitudinous "pinholes" which may ultimately allow water to pass through the fabric. To render the primarily treated fabric completely water resistant, one or more polymeric films are adhered to the back side of the fabric, depending on the desired degree of water resistance. The primarily treated fabric having one or more polymeric films adhered thereto results in a secondarily treated fabric.

A more detailed description of how to make and practice the present invention follows below. It should be understood that the term "weight percent", as used herein with respect to the components of the compositions of the present invention, refers to the total weight (i.e., the "wet weight") of the components of the compositions of the present invention and not to the weight percents of the solids or polymers (i.e., the "dry weight") in the components of the compositions of the present invention, unless otherwise specified.

The process of treating fabric in accordance with the present invention involves the application of the treatment composition to the fabric. The application of the treatment composition is then followed by oven drying and curing, resulting in the primarily treated fabric.

The treatment composition minimally contains a fluorochemical textile treating agent and water. In preferred embodiments, the treatment composition may further include antimicrobial agents, a crosslinking agent, a fire retardant and/or smoke suppressant, and other additives and auxiliaries such as dispersants, thickeners, dyes, pigments, ultraviolet light stabilizers, and the like. It would not depart from the spirit of the invention to include a minor amount of a dispersible polymer latex. However, the viscosity of the treatment composition must be low enough that thorough penetration of the fabric can be obtained.

The fluorochemical textile treating agent is preferably a latex and comprises from about 5 to about 20 weight percent of the treatment composition, based on the weight of the treatment composition, more preferably from about 6 to about 12 weight percent, and most preferably about 10 weight percent. The fluorochemicals provide water repellency, water resistance and stain resistance and may comprise unbranded generic fluoropolymers. Suitable fluorochemical treating agents include, but are not limited to, the commercially available fluorochemical compositions SCOTCHGUARD™ FC 255, SCOTCHGUARD™ FC 214-230, available from 3M, and ZONYL™ RN, ZONYL™ 8070, and ZONYL™ 8787, available from E.I. Dupont de Nemours, and mixtures thereof. ZONYL™ 8070 is the most preferred fluorochemical treating agent for use in the treatment composition. The fluorochemical treating agent typically comprises from about 5 to about 25 weight percent solids, based on the weight of the fluorochemical treating agent, and preferably comprises from about 8 to about 20 weight percent solids, and most preferably comprises about 18.5 weight percent solids. The amount of fluorochemical treating agent used in the treatment composition of the present invention is considerably higher than that traditionally used for treating upholstery fabric to render it stain resistant.

A latex antimicrobial agent preferably comprises from about 0.25 to about 4 weight percent of the treatment composition, based on the weight of the treatment composition, and more preferably from about 0.40 to about 2 weight percent, and most preferably about 0.60 weight percent. By "antimicrobial agent" it is meant any substance or combination of substances that kills or prevents the growth of a microorganism, and includes antibiotics, antifungal, antiviral and antialgal agents. The most preferred antimicrobial agent is ULTRAFRESH™ DM-25, available from Thomas Research. Another preferred antimicrobial agent is AMICAL FLOWABLE™, available from Angus Chemical Company of Northbrook, Ill. Other antimicrobials, particularly fungicides, may be used. Suitable examples include, but are not limited to, various tin compounds, particularly trialkyltin compounds such as tributyl tin oxide and tributyl tin acetate, copper compounds such as copper 8-quinolinolate, metal complexes of dehydroabietyl amine and 8-hydroxyquinolinium 2-ethylhexoate, copper naphthenate, copper oleate, and organosilicon quarternary ammonium compounds.

Crosslinking agents suitable for use in the treatment composition include resins which are themselves crosslinkable. Preferably, the crosslinking agent is a latex. Preferred self-crosslinking resins are the various melamine/formaldehyde and phenol/formaldehyde resins and their variants. Such as WT-50™, a product of the B.F. Goodrich Company and Astromel NW3A. The most preferred self-crosslinking agent is Astromel NW3A™, a product of Astro Industries, a division of Borden Chemical Company, of Morganton, N.C., which comprises about 80 weight percent solids and 20 weight percent water. Suitable other self-crosslinking resins include, but are not limited to, phenol, melamine, urea, and dicyandiamide based formaldehyde resins, which are available commercially, for example, from the Borden Chemical Company, of Columbus, Ohio. Preferably the self-crosslinking agent is present in the treatment composition in an amount of from about 0.1 to about 3.0 weight percent, based on the weight of the treatment composition, and more preferably in an amount of less than about 1.0 weight percent. Most preferably, the self-crosslinking agent is Astromel NW3A™ and is present in the treatment composition in an amount of about 0.25 weight percent, based on the weight of the treatment composition. Other crosslinkable resins such as oligomeric unsaturated polyesters, mixtures of polyacrylic acid and polyols, e.g. polyvinylalcohol, aliphatic and aromatic polyurethanes and epoxy resins may also be used, together with any necessary catalysts to ensure crosslinking during the oven drying cycle.

The primarily treated fabrics produced by the subject process can have flame retardants and/or smoke suppressants added to them to improve the flame retardency of the fabrics. Suitable flame retardants are known to those skilled in the art of fabric finishing, and include, for example, cyclic phosphorate esters such as Antiblaze™ 19T available from Mobil Chemical Co.

The treatment composition is prepared by mixing the antimicrobial agent, the fluorochemical treating agent, the crosslinking agent and any other ingredients in water until a uniform dispersion is obtained. The water is present in the treatment composition in an amount of from about 70 to about 95 weight percent, based on the weight of the treatment composition, and more preferably from about 80 to about 90 weight percent, and most preferably about 84–89 weight percent.

The fabric to be primarily treated may be drawn through a bath of the treatment composition by any convenient method, or the treatment composition may be sprayed or rolled onto the fabric. Preferably, the fabric, previously scoured to remove textile yarn finishes, soaps, etc., is drawn through a bath of the treatment composition, as the treatment composition should uniformly coat both surfaces of the fabric as well as its interior. The fabric, after being drawn through a bath of the treatment composition, may be passed through nips or nip rollers to facilitate more thorough penetration of the treatment composition into the fabric and/or to adjust the amount of the treatment composition relative to the fabric (i.e. wet pickup). By such or other equivalent means, the wet pickup is adjusted to provide from about 30 to about 200 weight percent wet pickup relative to the weight of the untreated fabric, more preferably from about 60 to about 150 weight percent, and most preferably from about 80 to about 120 weight percent. About a 100 weight percent addition of treatment composition relative to the weight of the untreated fabric is considered optimal with, normal treatment composition solids content.

The coated fabric is then passed through an oven maintained at an elevated temperature, preferably from 250° F. to 350° F. (121° C. to 277° C.) for a period of time sufficient to cure the applied treatment composition. By the term "cure", as used in the previous sentence, it is meant to dry the applied treatment composition, and, if the first application of treatment composition is not to be followed by additional treatments, to perform any necessary crosslinking of the components of the treatment composition. Generally, a period of from about 1 to 8 minutes, preferably about 2 minutes at 325° F. (163° C.) is sufficient.

The primarily treated fabric of the subject invention has a number of advantageous and unique characteristics. It is highly, although not totally, water resistant, as well as being water repellant and stain resistant. While being highly water resistant, the primarily treated fabric allows ready passage of water vapor, and is thus eminently suited for items such as boat covers, which have traditionally been made of vinyl top coated fabrics. The vinyl top coated fabrics are substantially water vapor impermeable, and contribute to mildew formulation in boats using such covers. The primarily treated fabric has substantially the same hand, feel, texture, and drape of uncoated fabric, and thus can be manipulated by traditional manufacturing techniques as well as being aesthetically pleasing. The primarily treated fabric is also considerably more resistant to tear and opening at needle holes, as well as having higher tensile strength.

To render the fabric more completely water resistant, one or more polymeric films are adhered to the back of the fabric, depending on the degree of water resistancy desired. The adherence of one or more polymeric films to the back of the fabric is designed to render the fabric virtually totally water resistant. The polymeric film being adhered to the back of the fabric does not appreciably interfere with the hand and feel of the fabric. Moreover, the adherence of the polymeric film to the back of the fabric does not interfere with the aesthetic qualities of the fabric as the polymeric film is generally hidden from view during its preferred use, such as seating upholstery, curtains, etc.

The polymeric film can be any film formed by any fabrication technique known in the art, and may preferably be an extruded or cast film. The thickness of the polymeric film will generally range from about 0.5 mils (0.013 mm.) to about 10 mils (0.26 mm.) although thinner, as well as thicker, films can be used, if desired.

The polymeric film may be made of any curable or crosslinkable polymer, copolymer, blend, and the like, of polymeric material. Such polymeric materials can include, for example, and not by way of limitation, thermosetting and thermoplastic materials such as polyvinyl chloride, polyesters, polyamides, nylon, polysulfones, polyethylene, polypropylene, polychloroprene (neoprene), polystyrene, polymethylstyrene, polyethylene terephthalate, polyisoprene, polyvinyl acetate, polyvinylidene chloride, silicone resins, styrene-acrylonitrile copolymer resins, aliphatic and aromatic urethanes, and/or acrylates and their oligomers, polymethacrylates, isobornyl acrylate, polymethylmethacrylates, diol diacrylates, styrene-butadiene copolymers, polycarbonates, polycaprolactams, natural rubber latex, and blends thereof and coextrusions thereof. Other film forming materials will be obvious to those skilled in the art and are intended to be covered in the scope of the compositions, articles, and processes of the present invention.

The polymeric film can be adhered to the back of the fabric by any technique known in the art. One suitable technique in which the polymeric film can be adhered to the back of the fabric is employing the use of a thin suitable intermediate hot-melt adhesive layer (i.e., film of web) between the polymeric film and the fabric.

The intermediate hot-melt adhesive layer can be laminated between the fabric and the polymeric film by any known technique. The polymeric film is generally supplied from a roll of preformed polymeric film and a thin layer of hot-melt adhesive is melted between the fabric and polymeric film. The hot-melt adhesive is applied usually in an amount in the range of from about 0.25 to about 3 oz./yd$^2$ (9 to 100 g/m$^2$) depending upon the adhesive although, less or more adhesive could be used, if desired. The adhesive, after being heated, is then be allowed to cool, preferably at room temperature, to secure the polymeric film to the fabric.

Suitable hot-melt adhesives include, but are not limited to, hot-melt adhesives comprising at least one polyamide, polyester, polyolefin, polyurethane and combinations thereof. It should be noted that a bi-component film could be used to simplify the securing of a polymeric film to the fabric. In a bi-component film, the hot-melt adhesive is provided preformed on one side of a polymeric film.

Adhesives other than hot-melt adhesives (such as liquid adhesives) can also be used. Suitable liquid adhesives for use are well known in the art. Some examples include plastisol, epoxy, acrylic, organosol and urethane adhesives. The liquid adhesives can be applied to the polymeric film by known coating techniques (gravure cylinder, knife, roller, reverse roller, anilox roller etc.), laminated under heat between the film and the fabric and allowed to cool to secure the film to the fabric. Plastisols are one of the best known liquid adhesive materials. These are dispersions of finely divided polymeric materials in nonvolatile organic liquids and low melting solids, generally referred to as plasticizers. Suitable plasticizers include phthalate, adipate and sebaccate esters and polyols such as ethylene glycol and its derivatives. A typical plastisol composition is between about 50 to about 95 parts polymeric material and about 5 to about 50 parts plasticizer. After the plastisol is deposited on the polymeric film, the film and the fabric are married (i.e., brought into contact with each other) so that the plastisol is disposed therebetween. Heat is then supplied to raise the temperature of the plastisol to above about 300° F. to about 400° F. to form a solid layer of PVC adhesive between the polymeric film and the fabric.

Another suitable technique in which the polymeric film can be adhered to the back of the fabric is to directly attach the polymeric film to the fabric without the use of an intermediate adhesive layer. This can be done in any suitable manner known in the art. Examples of suitable techniques include direct calender lamination and extrusion lamination. These techniques can produce a composite article without the use of an intermediate adhesive layer. In these fabrication techniques, the polymeric film acts as the adhesive because it is brought in contact with the fabric shortly after formation before the polymeric film completely cools. A mechanical bond forms between the fabric and the polymeric film when the polymeric film cools.

In direct calender lamination, the polymeric material is squeezed between two rollers to form a polymeric film. The fabric is fed off of another roller so that the fabric passes directly under the calendered polymeric film to receive the calendered polymeric film before the polymeric film completely cools. The fabric and its polymeric film can then be fed through pressure rollers to facilitate a more thorough penetration of the polymeric film into the fabric. A mechanical bond forms between the fabric and polymeric film when the film cools thereby securing the film to the fabric. The fabric and film can then be taken up on a roll.

Direct extrusion lamination is somewhat similar to direct calendar lamination. The main difference is that, in direct extrusion lamination, the polymeric film is extruded through a die onto the fabric, rather than being calendered onto the fabric.

Another suitable technique in which the fabric can be coupled with a polymeric film is to deposit, a plastisol or a similar material, such as organosol, onto the fabric and then to cure the deposited plastisol material to form a polymeric film adhered to the fabric. Depositing plastisol material directly onto the fabric works best when the fabric is relatively smooth. For relatively course fabrics, the plastisol material may first be deposited on a smooth carrier surface, such as a silicone release paper, and then be transferred to the fabric after the plastisol begins to gel, but before solidifying.

It is preferred that the primary treatment precede the application of the polymeric film(s) to the fabrics. However, the polymeric film(s) could be adhered to the fabric before the primary treatment or polymeric film(s) could first be adhered to the fabric, followed by the primary treatment, which could then be followed by adhering addition polymeric film(s) to the previously adhered polymeric film(s).

As mentioned above, the fabric of the present invention is durable, easy to handle and economical to produce. Because the fabric of the present invention retains its "hand" or texture (i.e., does not feel like plastic), the fabric is easy to sew and seams are less noticeable, and more durable. For example, when vinyl is sewed, the needle holes tend to open when the vinyl is stretched. With the fabric of the present invention, needle holes do not tend to open and thus the seams are stronger and less noticeable. Moreover, while the fabric of the present invention provides a moisture barrier, it is believed that vapors are allowed to pass through the fabric. Human skin which may come in contact with the fabric of the present invention, for example in upholstery applications, is therefore less likely to perspire. The fabric of the present invention may also be transfer printed.

The following Specific Examples further describes the present invention.

EXAMPLE 1

A previously dyed jacquard fabric is immersed into a bath of primary treatment composition containing 10.23 weight percent ZONYL™ 8070 fluorochemical, 0.25 weight percent WT-50™ melamine/formaldehyde resin, and 0.6 weight percent of ULTRAFRESH™ DM-25 biocide, and 88.92 weight percent water.

The primary treatment composition is prepared by first adding to a mixture of the WT-50™ resin and the Ultrafresh™ DM-25 to the water. The ZONYL™ 8070 is then added to the water mixture (i.e., the water, WT-50™ and the Ultrafresh™ D-25). Each of the components are added while agitating the mixture.

The treated fabric is passed through nip rolls whose pressure is adjusted to provide for 100% primary treatment composition pickup. The fabric is then dried by passage through a drying oven. The resulting treated fabric displays virtually no change in color, is able to support a considerable column of water, indicating good water resistancy, and is stain resistant. The resulting fabric is water vapor permeable, and has excellent hand, feel, and texture. The tear strength and tensile strength are considerably improved relative to the untreated fabric. Examination of the treated fabric against a strong light showed the presence of numerous pinholes.

The primarily treated fabric, when viewed against a strong light, exhibits numerous pinholes, but is substantially water resistant, water repellant and stain resistant. The primarily treated fabric then has a polymeric film adhered to its back side.

The resulting fabric is virtually totally water resistant, supporting a higher column of water than the same fabric after treatment with the primary treatment composition only. Moreover, examination under a strong light shows evidence of no pinholes. The fabric has excellent hand and feel, although it is somewhat stiffer than the virgin fabric. The fabric has the appearance and feel of fabric, not of plastic.

Those skilled in the art can now appreciate from the foregoing description that the broad teachings of the present invention can be implemented in a variety of forms.

Therefore, while this invention has been described in connection with particular examples thereof, the true scope of the invention should not be so limited since other modifications will become apparent to the skilled practitioner upon a study of the specification and following claims.

What is claimed is:

1. A stain resistant, water resistant and water repellant treated textile fabric, the fabric prepared by a process comprising:

a) selecting an untreated textile fabric having a first side and a second side;

b) topically treating the untreated fabric with an aqueous primary treatment composition comprising:

b)i) from about 6 weight percent to about 12 weight percent of a fluorochemical textile treating agent, based on the weight of the primary treatment composition;

c) drying and curing the topically treated fabric at an elevated temperature to obtain a primarily treated fabric; and d) securing at least one polymeric film to one side of the fabric.

2. The treated fabric of claim 1 wherein both sides of the untreated fabric are exposed to the primary treatment composition in step (b).

3. The treated fabric of claim 1 wherein the primary treatment composition further comprises from about 0.25 weight percent to about 4 weight percent of an antimicrobial agent, based on the weight of the primary treatment composition.

4. The treated fabric of claim 3 wherein the primary treatment composition further comprises a crosslinkable resin in an amount of from 0.1 weight percent to about 3 weight percent, based on the weight of the primary treatment composition.

5. The treated fabric of claim 4 wherein the crosslinkable resin comprises a melamine/formaldehyde resin.

6. The treated fabric of claim 4 wherein the primary treatment composition further comprises water in an amount of from about 70 weight percent to about 95 weight percent, based on the weight of the primary treatment composition.

7. The treated fabric of claim 1 wherein the polymeric film is secured to the back side of the fabric such that, when the fabric is in use, the polymeric film faces away from view.

8. The treated fabric of claim 7 wherein the polymeric film is secured to the fabric after (c) obtaining a primarily treated fabric.

9. The treated fabric of claim 7 wherein the polymeric film is secured to the fabric before (c) obtaining a primarily treated fabric.

10. The treated fabric of claim 1 wherein an adhesive is provided to secure the polymeric film to the fabric.

11. The treated fabric of claim 1 wherein a mechanical bond between the polymeric film and the fabric secures the film to the fabric.

12. The fabric of claim 1 wherein the fabric is a woven fabric.

13. The fabric of claim 1 wherein the fabric is a jacquard.

14. The treated fabric of claim 2 wherein the primary treatment composition penetrate through the fabric and cover the interstitial spaces within the fabric.

15. A seating upholstery comprising the treated fabric of claim 1.

16. A process for the preparation of a treated fabric, the process comprising:

a) providing an untreated fabric;

b) topically treating the untreated fabric with an aqueous treatment composition comprising:

b)i) from about 6 weight percent to about 12 weight percent of a fluorochemical textile treating agent, based on the weight of the treatment composition;

c) drying and curing the topically treated fabric at an elevated temperature to obtain a primarily treated fabric; and d) securing a polymeric film to one side of the primarily treated fabric.

17. The process of claim 16 wherein the polymeric film is secured to the fabric after (c) obtaining a primarily treated fabric.

18. The process of claim 16 wherein the polymeric film is secured to the fabric before (c) obtaining a primarily treated fabric.

19. The process of claim 16 wherein the polymeric film is secured to the back side of the fabric such that, when the fabric is in use, the polymeric film faces away from view.

20. The process of claim 16 wherein an adhesive is provided to secure the polymeric film to the fabric.

21. The process of claim 16 wherein a mechanical bond between the polymeric film and the fabric secures the film to the fabric.

22. The process of claim 16 wherein the primary treatment composition further comprises from about 0.25 weight percent to about 4 weight percent of an antimicrobial agent, based on the weight of the primary treatment composition.

23. The process of claim 22 wherein the primary treatment composition further comprises a crosslinkable resin in an amount of from 0.1 weight percent to about 3 weight percent, based on the weight of the primary treatment composition.

24. The process of claim 23 wherein the crosslinkable resin comprises a melamine/formaldehyde resin.

25. The process of claim 23 wherein the primary treatment composition further comprises water in an amount of from about 70 weight percent to about 95 weight percent, based on the weight of the primary treatment composition.

26. The process of claim 16 wherein the fabric is a woven fabric.

27. The process of claim 16 wherein the fabric is a jacquard.

28. A treated textile fabric comprising:

a textile fabric having a first side and a second side;

a coating on at least one side of the fabric, the coating comprising the cured product of an aqueous primary treatment composition comprising from about six weight percent to about 12 weight percent of a fluorochemical textile treating agent, based on the weight of the primary treatment composition; and a polymeric film secured to at least one side of the fabric.

29. The treated fabric of claim 28 wherein both sides of the fabric are coated with the cured product of the primary treatment composition.

* * * * *